US009358803B2

(12) United States Patent
Moriguchi et al.

(10) Patent No.: US 9,358,803 B2
(45) Date of Patent: Jun. 7, 2016

(54) LIQUID SUPPLYING APPARATUS, LIQUID EJECTING APPARATUS, AND LIQUID SUPPLYING METHOD

(71) Applicant: CANON KABUSHIKI KAISHA, Tokyo (JP)

(72) Inventors: Takuto Moriguchi, Kamakura (JP); Shuzo Iwanaga, Kawasaki (JP); Kazuhiro Yamada, Yokohama (JP); Zentaro Tamenaga, Sagamihara (JP); Takatsugu Moriya, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/692,478

(22) Filed: Apr. 21, 2015

(65) Prior Publication Data

US 2015/0314607 A1 Nov. 5, 2015

(30) Foreign Application Priority Data

Apr. 30, 2014 (JP) ..... 2014-093758
Feb. 24, 2015 (JP) ..... 2015-034180

(51) Int. Cl.
*B41J 2/175* (2006.01)
*B05B 7/24* (2006.01)

(52) U.S. Cl.
CPC ..... *B41J 2/17596* (2013.01); *B05B 7/24* (2013.01)

(58) Field of Classification Search
USPC ..... 347/85, 86, 89, 92, 93
See application file for complete search history.

(56) References Cited

U.S. PATENT DOCUMENTS

| | | | | |
|---|---|---|---|---|
| 6,382,786 | B2 | 5/2002 | Iwanaga et al. | 347/86 |
| 6,419,349 | B1 | 7/2002 | Iwanaga et al. | 347/86 |
| 6,527,381 | B1 | 3/2003 | Udagawa et al. | 347/86 |
| 6,652,949 | B2 | 11/2003 | Iwanaga et al. | 428/65.9 |
| 6,742,881 | B2 | 6/2004 | Kotaki et al. | 347/86 |
| 7,156,507 | B2 | 1/2007 | Aruga et al. | 347/85 |
| 2002/0113853 | A1 | 8/2002 | Hattori et al. | 347/86 |
| 2002/0180847 | A1 * | 12/2002 | Jones | B41J 2/17506 347/86 |
| 2003/0043241 | A1 | 3/2003 | Hattori et al. | 347/86 |
| 2006/0181584 | A1 * | 8/2006 | Nip | B41J 2/17556 347/86 |
| 2007/0120913 | A1 * | 5/2007 | Mukai | B41J 2/175 347/93 |
| 2007/0252877 | A1 * | 11/2007 | Okubo | B41J 2/17509 347/93 |

FOREIGN PATENT DOCUMENTS

JP 2000-103074 4/2000

OTHER PUBLICATIONS

U.S. Appl. No. 14/692,486, filed Apr. 21, 2015.
U.S. Appl. No. 14/685,820, filed Apr. 14, 2015.

* cited by examiner

*Primary Examiner* — Kristal Feggins
(74) *Attorney, Agent, or Firm* — Fitzpatrick, Cella, Harper & Scinto

(57) ABSTRACT

In the present invention, an air bubble residing in a filter chamber is purged at a high speed without inducing liquid ejection deficiency at a liquid ejection head. A filter chamber is divided into a first filter chamber and a second filter chamber via a filter. A pump circulates ink through an ink tube and a bypass path between an ink tank and the first filter chamber. A valve capable of regulating a flow of the ink is provided at the ink tube that allows the second filter chamber and a print head to communicate with each other.

15 Claims, 5 Drawing Sheets

LIQUID SUPPLYING APPARATUS, LIQUID EJECTING APPARATUS, AND LIQUID SUPPLYING METHOD

BACKGROUND OF THE INVENTION

1. Field of the Invention

The present invention relates to a liquid supplying apparatus for supplying liquid to a liquid ejection head through a filter, a liquid ejecting apparatus, and a liquid supplying method.

2. Description of the Related Art

A liquid supplying apparatus is exemplified by an ink supplying apparatus for supplying ink (i.e., liquid) contained in an ink tank (i.e., a liquid container) to an inkjet printing apparatus serving as a liquid ejecting apparatus. The printing apparatus is adapted to eject the ink, supplied by the ink supplying apparatus, from an inkjet print head (i.e., a liquid ejection head) so as to print an image. The ink supplying apparatus supplies the ink through a filter in order to inhibit the intrusion of waste to the print head. A filter chamber provided with the filter is divided into a first filter chamber and a second filter chamber via the filter. The ink contained in the ink tank is supplied to the print head through the first filter chamber, the filter, and the second filter chamber. An air bubble is liable to reside in the first filter chamber. In a case where the air bubble largely grows, the ink is inhibited from being supplied, possibly resulting in ink ejection deficiency at the print head.

Japanese Patent Laid-Open No. 2000-103074 discloses a method for pressurizing and circulating (pressure-circulating) ink between a first filter chamber and an ink tank so as to purge an air bubble in the ink contained in the ink tank in order to purge the air bubble residing in the first filter chamber.

In order to purge the air bubble residing in the first filter chamber at a high speed, it is necessary to increase a circulation amount of ink between the first filter chamber and the ink tank. A large-sized print head for ejecting a large quantity of ink is used in the business-grade printing field, in particular, thereby increasing the quantity of air bubbles residing in the first filter chamber. Thus, it is necessary to increase a circulation amount of ink so as to purge the air bubbles at a higher speed.

As disclosed in Japanese Patent Laid-Open No. 2000-103074, it is necessary to increase ink pressurizing force so as to increase the ink circulation amount in the method for pressure-circulating ink between the first filter chamber and the ink tank. However, in a case where the ink pressurizing force is increased, there is a possibility that the air bubble residing in the first filter chamber passes the filter, and then, intrudes into the print head through the second filter chamber.

SUMMARY OF THE INVENTION

The present invention provides a liquid supplying apparatus capable of purging an air bubble residing in a filter chamber at a high speed without inducing liquid ejection deficiency at a liquid ejection head, a liquid ejecting apparatus, and a liquid supplying method.

In the first aspect of the present invention, there is provided a liquid supplying apparatus configured to supply liquid to a liquid ejection head capable of ejecting liquid, the liquid supplying apparatus comprising: a liquid container configured to contain liquid therein; a filter chamber that is divided into a first filter chamber and a second filter chamber via a filter; a first supply path configured to allow the first filter chamber and the liquid container to communicate with each other; a second supply path configured to allow the second filter chamber and the liquid ejection head to communicate with each other; a bypass path configured to allow the first filter chamber and the liquid container to communicate with each other; a pump configured to circulate the liquid through the first supply path and the bypass path between the liquid container and the first filter chamber; and a valve capable of regulating the flow of the liquid in the second supply path.

In the second aspect of the present invention, there is provided a liquid ejecting apparatus comprising: the liquid supplying apparatus in the first aspect of the present invention; and a liquid ejection head capable of ejecting liquid to be supplied from the liquid supplying apparatus.

In the third aspect of the present invention, there is provided an inkjet printing apparatus comprising: the liquid supplying apparatus in the first aspect of the present invention, the liquid supplying apparatus supplying ink as liquid; an inkjet printing head configured to eject the ink to be supplied from the liquid supplying apparatus; and a moving unit configured to relatively move the inkjet printing head and a print medium.

In the fourth aspect of the present invention, there is provided a liquid supplying method of supplying liquid contained in a liquid container to a liquid ejection head by using a filter chamber divided into a first filter chamber and a second filter chamber via a filter, the liquid being supplied from the liquid container to the liquid ejection head through the first filter chamber, the filter, and the second filter chamber the liquid supplying method comprising the step of: regulating the flow of the liquid between the second filter chamber and the liquid ejection head in a case where the liquid is circulated between the liquid container and the first filter chamber.

In the fifth aspect of the present invention, there is provided a liquid supplying apparatus configured to supply liquid to a liquid ejection head capable of ejecting liquid, the liquid supplying apparatus comprising: a liquid container configured to contain liquid therein; a filter chamber that is divided into a first filter chamber and a second filter chamber via a filter; a first supply path configured to allow the first filter chamber and the liquid container to communicate with each other; a second supply path configured to allow the second filter chamber and the liquid ejection head to communicate with each other; a third supply path configured to allow the first filter chamber and the liquid container to communicate with each other; a pressurizing pump provided on the first supply path and configured to press-feed the liquid contained in the liquid container to the first filter chamber; and a valve provided on the second supply path, the valve comprising: a first chamber communicating with the second filter chamber via the second supply path; a second chamber communicating with the liquid ejection head via the second supply path; a communication path allowing the first chamber and the second chamber to communicate with each other; and a valve body capable of opening or closing the communication path, the valve body acting in a direction in which the communication path is closed according to an increase in pressure inside of the first chamber.

According to the present invention, the valve is provided on the second supply path that allows the filter chamber and the liquid ejection head to communicate with each other. Consequently, in a case where the liquid is circulated between the filter chamber and the liquid container, it is possible to suppress an influence on the liquid ejection head by pressure used for circulating the liquid. Thus, in order to purge an air bubble residing in the filter chamber at a high speed, it is possible to sufficiently increase pressurizing force or suction force to be exerted on the liquid so as to increase a circulation amount of liquid without considering an influence on the liquid ejection head. As a consequence, it is possible to purge the air bubble residing in the filter chamber without inducing liquid ejection deficiency at the liquid ejection head.

Further features of the present invention will become apparent from the following description of exemplary embodiments (with reference to the attached drawings).

DESCRIPTION OF THE EMBODIMENTS

Figure 1:
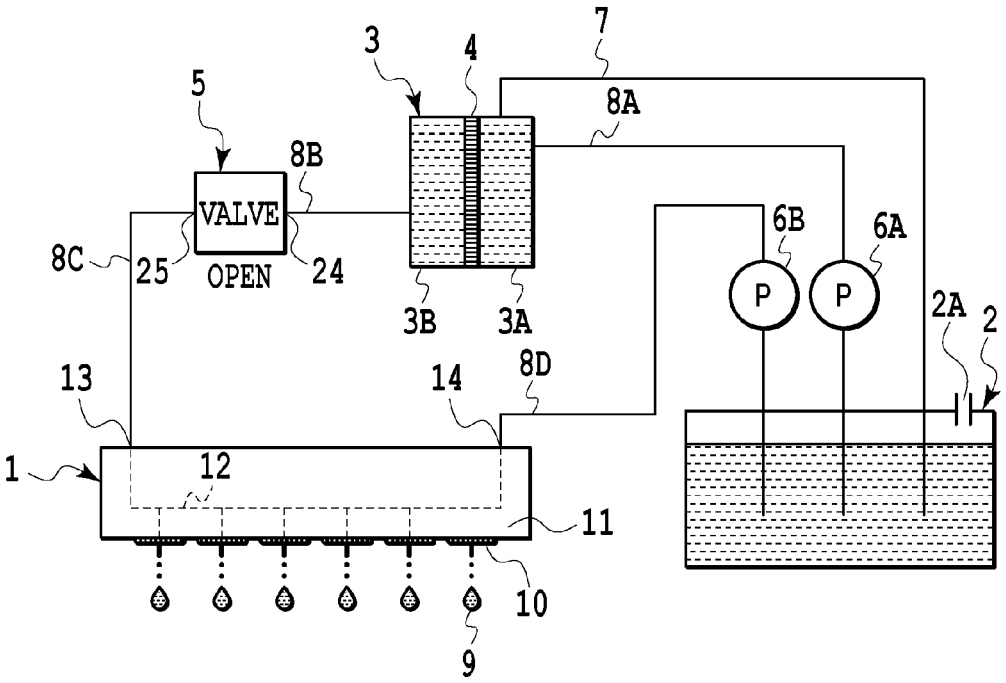
FIG. 1 is a view schematically showing a configuration of an ink supplying apparatus in an embodiment of the present invention.

An embodiment of the present invention will be described with reference to the attached drawings. A liquid supplying apparatus in the present embodiment is exemplified by an ink supplying apparatus for supplying ink to an inkjet print head (i.e., a liquid ejection head) capable of ejecting ink (i.e., liquid). The ink supplying apparatus in the present embodiment is provided for an inkjet printing apparatus (i.e., a liquid ejecting apparatus). FIG. 1 is a view used in explaining the basic configuration of the ink supplying apparatus.

First Embodiment

The ink supplying apparatus in the present embodiment includes a print head 1 capable of ejecting ink, an ink tank (i.e., a liquid container) 2, a filter chamber 3, and an openable/closable valve 5. These members are connected to each other via ink tubes 8 (8A, 8B, 8C, and 8D). The print head 1 is provided with a print element board 10 including a plurality of ejection ports and a plurality of ejection energy generating elements, and thus, is configured to eject an ink droplet (i.e., a liquid droplet) 9 from the ejection port by utilizing ejection energy generated by the ejection energy generating element. An electrothermal transducer (i.e., a heater), a piezoelectric element, or the like may be used as the ejection energy generating element. In the case of the use of the electrothermal transducer, ink is foamed by the generated heat, and thus, the ink droplet 9 can be ejected from the ejection port by utilizing the foaming energy.

An inkjet printing apparatus provided with the above-described ink supplying apparatus includes a moving mechanism for relatively moving the print head 1 and a print medium and a control unit for ejecting the ink droplet 9 from the print head 1 based on image data. The printing apparatus relatively moves the print head 1 and the print medium while ejecting the ink droplet 9 from the print head 1 so as to print an image on the print medium. The above-described printing apparatus may be of either a full line type or a serial scan type. A printing apparatus of the full line type sequentially conveys the print medium while ejecting ink from the print head so as to print an image. In the meantime, a printing apparatus of the serial scan type prints an image by repeating an operation for moving the print head in a main scanning direction while ejecting ink and an operation for conveying the print medium in a sub scanning direction crossing the main scanning direction.

Figure 5:
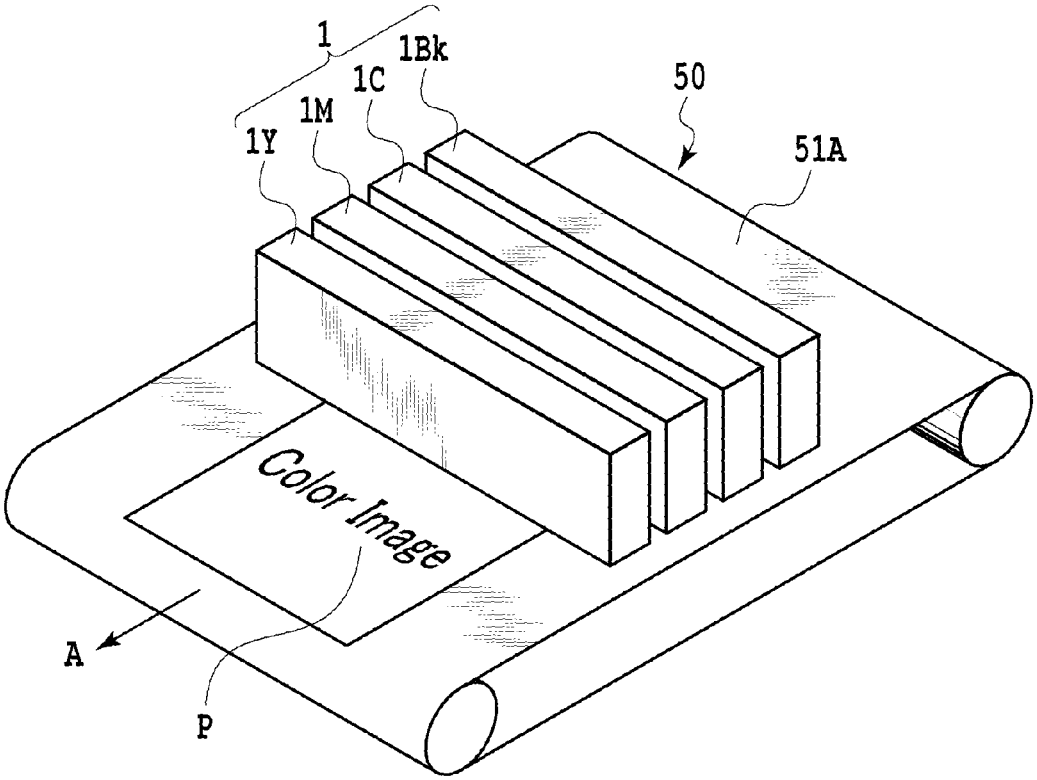
FIG. 5 is a view schematically showing a configuration of an inkjet printing apparatus that can be provided with the ink supplying apparatus shown in FIG. 1.

FIG. 5 is a schematically perspective view used in explaining a specific constitutional example of an inkjet printing apparatus of the full line type. The printing apparatus in the present embodiment is provided with print heads 1 (1Bk, 1C, 1M, and 1Y) for ejecting black (Bk), cyan (C), magenta (M), and yellow (Y) inks, respectively. A print medium P is conveyed in a direction indicated by an arrow A by a conveyance mechanism 50 using a conveyance belt 51A. In order to supply the inks corresponding to the print heads 1, respectively, each of the print heads 1 is provided with the ink supplying apparatus shown in FIG. 1. A plurality of ejection ports capable of ejecting the ink are formed at each of the print heads 1. The ejection ports form an ejection port array extending in a direction crossing (in the present embodiment, perpendicular to) the conveyance direction (i.e., the direction indicated by the arrow A) of the print medium P. While conveying the print medium P in the direction indicated by the arrow A by the conveyance mechanism 50, the inks are ejected from the print heads 1, so that a color image can be printed on the print medium P.

As shown in FIG. 1, the filter chamber 3 is provided with a filter 4 for suppressing waste or the like from intruding into the print head 1. The filter 4 divides the filter chamber 3 into an upstream filter chamber (i.e., a first filter chamber) 3A positioned upstream in an ink supply direction with respect to the print head 1 and a downstream filter chamber (i.e., a second filter chamber) 3B positioned downstream in the supply direction. The ink tank 2 and the upstream filter chamber 3A communicate with each other via the ink tube 8A forming a first supply path and a bypass path (i.e., a third supply path) 7. At the ink tube 8A is provided a first pump (i.e., a pressurizing pump) 6A such as a tube pump so as to feed the ink contained in the ink tank 2 to the upstream filter chamber 3A. The downstream filter chamber 3B and an inlet 24 formed at the valve 5 communicate with each other via the ink tube 8B. The ink passing the filter 4 is fed to the valve 5. An outlet 25 formed at the valve 5 and an ink inlet 13 formed at the print head 1 communicate with each other via the ink tube 8C. The ink is supplied from the valve 5 to an ink channel 12 formed in the print head 1. The ink tubes 8B and 8C form a second supply path for supplying the ink staying in the downstream filter chamber 3B to the print head 1. The ink supplied to the ink channel 12 is fed to the print element board 10, and then, is ejected from the ejection port in the form of the ink droplet 9 by an ejection energy generating element such as an electrothermal transducer. The ink channel 12 communicates with an ink outlet 14 that communicates with the ink tank 2 via the ink tube 8D. The ink tube 8D is provided with a second pump 6B such as a tube pump for feeding the ink into the ink tank 2 from the ink outlet 14.

In the print head 1 in the present embodiment, the plurality of print element boards 10 are arranged in a zigzag on a base board 11, thus configuring an elongate print head for use in the inkjet printing apparatus of a so-called full line type. The above-described print head is suitable for a business-grade printing apparatus that requires printing a wide image at a high speed. The number of print element boards 10 to be arranged is not limited to six, like the present embodiment. A wider image can be printed by increasing the number of print element boards 10 to be arranged. With the above-described print head 1, as wide an image as 4 to 12 inches can be printed at a high speed. The total ejection quantity of ink is remarkably large in the above-described elongate print head 1, and further, the total ejection quantity of ink is further increased in a case where the ink is ejected from the ejection port at a higher frequency at the recent request of printing at a higher speed.

Figure 2A:
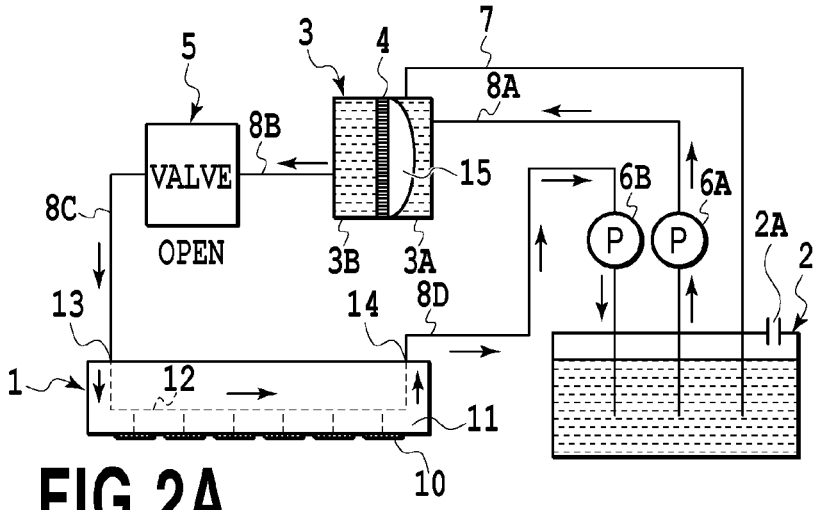
FIGS. 2A, 2B, and 2C are views used in explaining an operation of the ink supplying apparatus shown in FIG. 1.

As shown in FIG. 2A, during a printing operation, the valve 5 is opened, and further, the first and second pumps 6A and 6B are operated so that a predetermined negative pressure is maintained inside of the print head 1 while the ink is supplied to the print head 1 through the filter chamber 3 and the valve 5. Specifically, the ink contained in the ink tank 2 is pressure-supplied to the upstream filter chamber 3A by the first pump 6A, and further, the ink staying in the print head 1 is sucked by the second pump 6B. Consequently, the predetermined negative pressure is maintained inside of the print head 1 while the ink is supplied to the print head 1. A communication port 2A allows the ink tank 2 to communicate with the atmosphere. Therefore, an air bubble residing in the ink can be purged inside of the ink tank 2. In a case where some air bubbles residing in the ink that cannot be purged from the ink tank 2 flows into the ink tube 8A, and further, in a case where dissolved air residing in the ink grows to produce air bubbles, the air bubbles are liable to reside in the upstream filter chamber 3A and be caught on the filter 4 inside of the upstream filter chamber 3A, in particular. The air bubbles residing inside of the upstream filter chamber 3A aggregate, and thus, are turned into a large air bubble 15 shown in FIG. 2A. In this case, the ink is inhibited from being supplied, thereby possibly inducing ink ejection deficiency or the like. In the case of, in particular, the elongate print head 1 in the present embodiment, a quantity of air bubbles 15 residing in the filter 4 is likely to be increased according to an increase in total ink ejection amount.

Figure 2B:
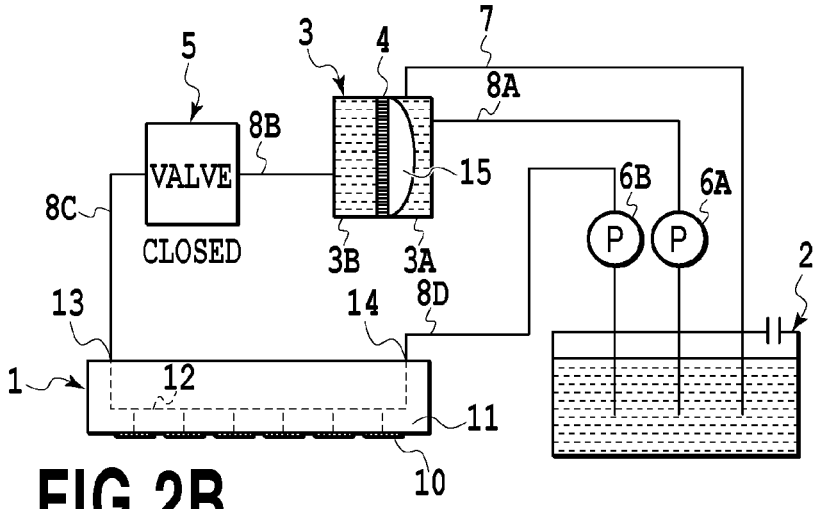
Figure 2C:
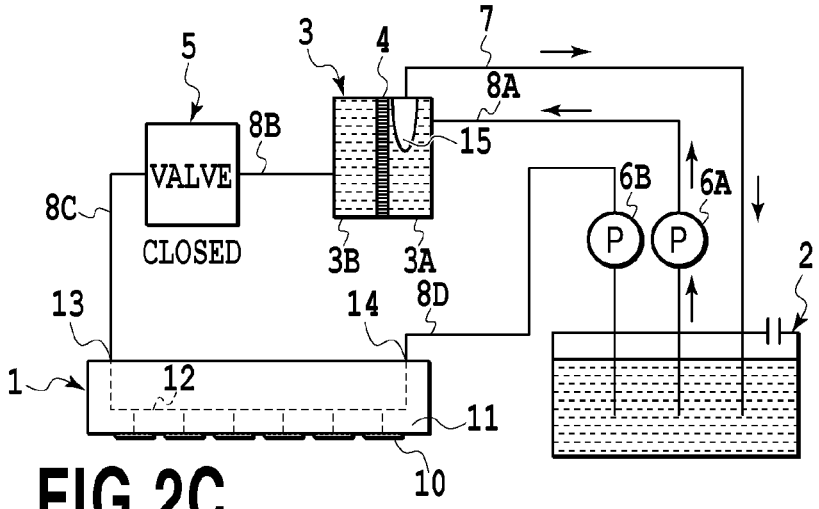

An operation (ink circulation purging) for purging the above-described air bubble 15 is performed in the present embodiment. First, the valve 5 is closed, and further, the pumps 6A and 6B are stopped, thereby stopping the ink supply, as shown in FIG. 2B. In this manner, the air bubble 15 is prevented from intruding into the print head 1. Thereafter, the first pump 6A is driven so that the ink contained in the ink tank 2 is press-fed to the upstream filter chamber 3A, and then, the ink staying in the upstream filter chamber 3A is returned to the ink tank 2 through the bypass path 7, as shown in FIG. 2C. In this manner, the ink is circulated between the ink tank 2 and the upstream filter chamber 3A so that the air bubble 15 is retrieved with the ink, thus purging the air bubble 15 from the ink inside of the ink tank 2. At this time, since the valve 5 is closed, it is possible to suppress the intrusion of the air bubble 15 into the downstream filter chamber 3B and the print head 1 from the upstream filter chamber 3A. Consequently, the pump 6A can be driven by a strong ink press-feeding force (i.e., the pressurizing force), so that the intrusion of the air bubble into the print head 1 can be suppressed while the air bubble 15 can be purged at a high speed.

Any valves may be used as the valve 5 as long as they can restrict the flow of the ink between the filter chamber 3 and the print head 1. In other words, any valves may be used as the valve 5 as long as their opening degrees can be adjusted in such a manner as to restrict the flow of the ink between the filter chamber 3 and the print head 1, and therefore, it is not always limited to a configuration capable of adjusting the valve in two steps, that is, opening and closing. Various kinds of valves such as a manual valve and an electrodynamic valve may be adopted as the valve 5.

Figure 3A:
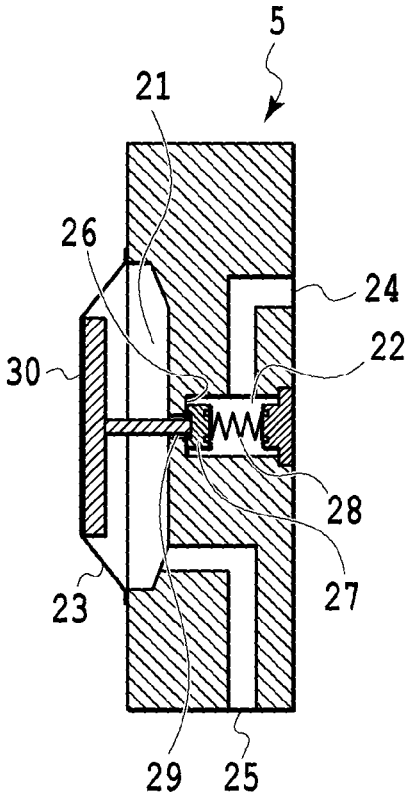
FIGS. 3A and 3B are cross-sectional views showing a valve shown in FIG. 1 in different states.
Figure 3B:
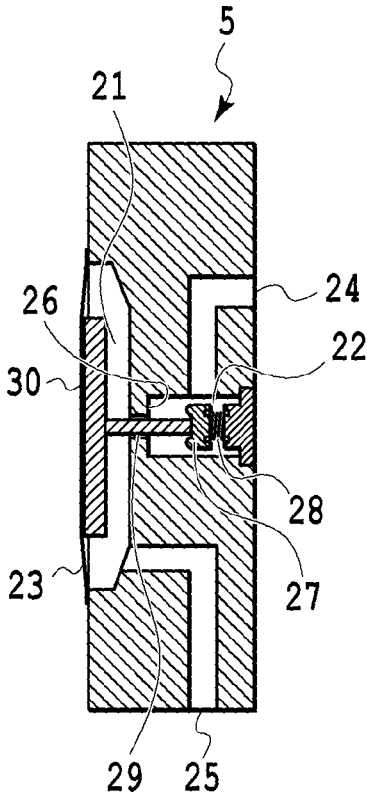

FIGS. 3A and 3B each are cross-sectional views showing the valve 5 in the present embodiment. A pressure chamber (i.e., a second chamber) 21 is defined at one surface of the main body of the valve 5 by a flexible formed film 23. The flexible film (i.e., a flexible member) 23 may be formed in various shapes such as a circle, an ellipse, and a rectangle. The main body of the valve 5 has an inlet 24 and an outlet 25 formed thereat. As described above, the inlet 24 communicates with the downstream filter chamber 3B via the ink tube 8B: in the meantime, the outlet 25 communicates with the ink inlet 13 of the print head 1 via the ink tube 8C. The ink introduced into the valve 5 from the downstream filter chamber 3B through the ink tube 8B is supplied to the print head 1 from the inlet 24 through an ink introduction chamber (i.e., a first chamber) 22, an ink introduction port (i.e., a communication path) 29, the pressure chamber 21, and the outlet 25.

A valve body 27 is interposed between the pressure chamber 21 and the ink introduction chamber 22. The valve body 27 is urged toward the pressure chamber 21, that is, in a direction in which the valve body 27 is brought into contact with a valve seat 26, by an urging member 28. The valve body 27 is brought into close contact with the valve seat 26, thereby closing the ink introduction port 29. Other than a coil spring, like the present embodiment, various resilient members such as a diaphragm may be used as the urging member 28. The valve body 27 is connected to a pressure plate 30 positioned inside of the flexible film 23. The ink introduction port 29 is opened or closed according to the displacement of the flexible film 23, thus adjusting the pressure of the ink to be supplied to the print head 1. The displacement of the flexible film 23 is transmitted to the valve body 27 via the pressure plate 30.

The operation of the valve 5 will be described below. In the case of the low negative pressure inside of the pressure chamber 21, the valve body 27 closes the ink introduction port 29 according to a difference in pressure between the pressure chamber 21 and the ink introduction chamber 22 and by the urging force of the urging member 28, as shown in FIG. 3A. The negative pressure inside of the pressure chamber 21 is increased according to an increase in ejection quantity of the ink from the print head 1, that is, an increase in consumption of the ink. And then, in a case where the negative pressure inside of the pressure chamber 21 is increased up to a predetermined value, the flexible film 23, the pressure plate 30, and the valve body 27 are displaced rightward in FIG. 3B against the urging force of the urging member 28, so that the valve body 27 opens the ink introduction port 29, as shown in FIG. 3B. In this manner, the ink, to which the predetermined negative pressure is applied, is supplied to the print head 1 from the ink introduction chamber 22 through the ink introduction port 29, the pressure chamber 21, and the ink outlet 25.

Figure 4:
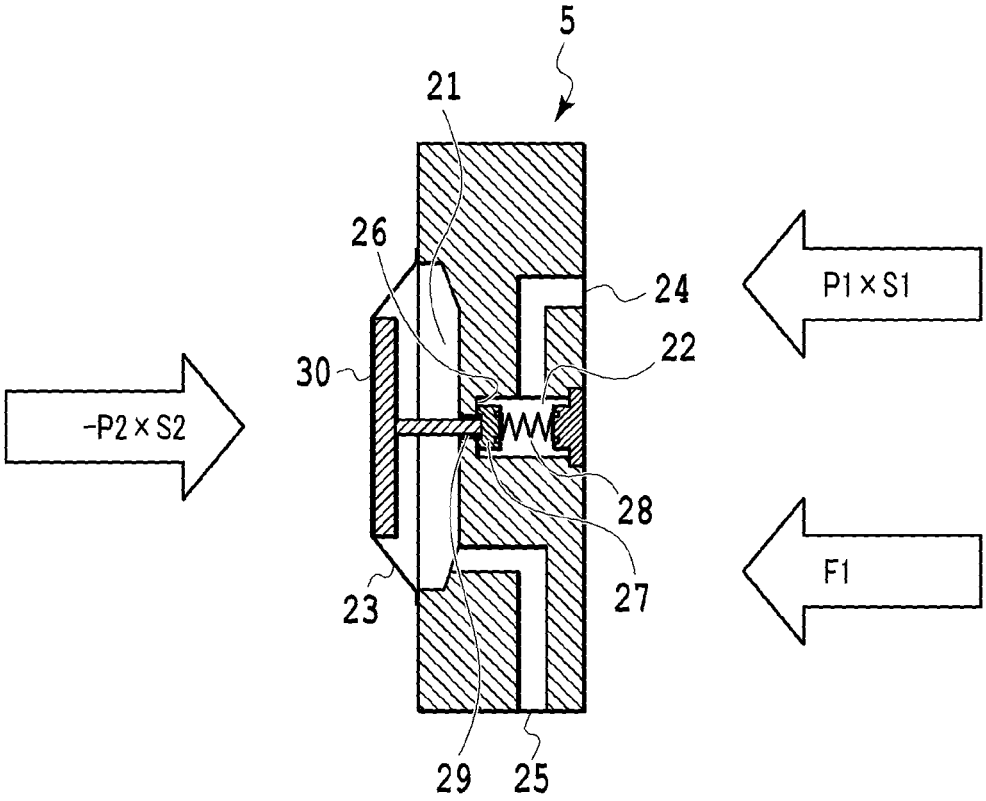
FIG. 4 is a view used in explaining a pressure relationship inside of the valve shown in FIG. 3A.

In a case where the force of the valve body 27 for opening the ink introduction port 29 and the force of the valve body 27 for closing the ink introduction port 29 balance with each other, the following equation (1) is established. As shown in FIG. 4, the force in a direction in which the valve body 27 closes the ink introduction port 29 is signed by plus: in contrast, the force in a direction in which the valve body 27 opens the ink introduction port 29 is signed by minus.

$$-P2\times S2=P1\times S1+F1 \qquad \text{Equation (1)}$$

Here, P2 denotes pressure inside of the pressure chamber 21; P1, pressure in the ink introduction chamber 22; S2, the area of the pressure plate 30 on the side of the pressure chamber 21. S1 denotes the area of a surface of the valve body 27 on the side of the ink introduction chamber 22, and further, the area of a surface in parallel to the pressure plate 30. F1 denotes the urging force of the urging member 28.

The above-described equation (1) may be changed into the following equation (2).

$$P2=-(P1\times S1)/S2-(F1/S2) \qquad \text{Equation (2)}$$

In a case where the pressure P1 inside of the ink introduction chamber 22 is increased in the balance state in which Equation (1) above is established, the valve body 27 is moved in the direction in which the ink introduction port 29 is closed. Consequently, in a case where the ink is pressurized by the first pump 6A in order to purge the air bubble 15 (i.e., the ink circulation purging), the pressure in the ink introduction chamber 22 becomes large, thus automatically closing the ink introduction port 29. As a consequence, the movement of the air bubble 15 residing inside of the filter chamber 3A to the downstream filter chamber 3B is suppressed. Thus, the ink is sufficiently pressurized by the first pump 6A, and then, a large quantity of ink is circulated between the ink tank 2 and the upstream filter chamber 3A, so that the air bubble 15 can be prevented from intruding into the print head 1 while the air bubble 15 can be purged at a high speed.

Second Embodiment

The first embodiment is exemplified by a system for pressurizing the ink by the first pump 6A (i.e., a pressurization circulation system) so that the ink is circulated between the ink tank 2 and the upstream filter chamber 3A. In the meantime, a system in which the ink is circulated between the ink tank 2 and the upstream filter chamber 3A by sucking the ink (i.e., a suction circulation system) may be adopted.

For example, the pump 6A disposed on the way of the ink tube 8A in FIG. 1 may be replaced by a suction pump disposed on the bypass path 7. The suction pump sucks the ink staying in the upstream filter chamber 3A and returns the ink to the ink tank 2. In such a suction circulation system, the valve 5 is closed in a case where the ink is sucked and circulated, thereby avoiding an influence of the negative pressure by the ink suction force from being exerted on the print head. That is to say, it is possible to prevent any breakage of a meniscus of the ink formed at the ink ejection port of the print head 1. The valve 5 can be such configured that in a case where the inside pressure of the ink introduction chamber 22 becomes a predetermined negative pressure or higher, the valve body 27 automatically closes the ink introduction port 29.

In the present embodiment, the suction force of the suction pump is sufficiently increased, and then, the ink is circulated in a great quantity between the ink tank and the upstream filter chamber 3A, thus avoiding an influence of the ink suction force from being exerted on the print head 1 while purging the air bubble 15 at a high speed.

Example 1

In Example 1, the ink supplying apparatus shown in FIG. 1 was fabricated, in which a manual two-way valve was used as the valve 5. After the valve 5 was closed, the ink was pressurized up to 100 kPa by the first pump 6A so as to purge the air bubble 15 (i.e., the ink circulation purging). The air bubble 15 residing in the upstream filter chamber 3A did not intrude into the downstream filter chamber 3B since the valve 5 was closed, and thus, it was retrieved to the ink tank 2 through the bypass path 7. In the end, the air bubble 15 could be purged.

Example 2

In Example 2, the ink supplying apparatus shown in FIG. 1 was fabricated, in which a valve shown in FIG. 3A was fabricated under the condition shown in Table 1 below, and then, it was used as the valve 5. The ink was pressurized up to 100 kPa by the first pump 6A so as to purge the air bubble 15 (i.e., the ink circulation purging).

TABLE 1

| | |
|---|---|
| Area S1 of valve body ($mm^2$) | 4.5 |
| Area S2 of pressure plate ($mm^2$) | 530 |
| Spring constant of urging member (gf/mm) | 5 |
| Initial urging force of urging member (gf) | 30 |

The valve body 27 inside of the valve 5 closed the ink introduction port 29 by the pressurizing force of the first pump 6A and the urging force of the urging member 28. Consequently, the air bubble 15 residing in the upstream filter chamber 3A did not intrude into the downstream filter chamber 3B since the valve 5 was closed, and thus, it was retrieved to the ink tank 2 through the bypass path 7. In the end, the air bubble 15 could be purged.

In Comparative Example 1, the valve 5 was detached from the ink supplying apparatus shown in FIG. 1. The ink was pressurized up to 100 kPa by the first pump 6A so as to purge the air bubble 15 (i.e., the ink circulation purging). The air bubble 15 residing in the upstream filter chamber 3A passed the filter 4 under the pressure by the pump 6A. The air bubble 15 was turned into fine air bubbles, and then, intruded into the print head 1, thereby inducing ink ejection deficiency.

The present invention is widely applicable to a liquid supplying apparatus for supplying various kinds of liquid and a liquid ejecting apparatus capable of ejecting various kinds of liquid. Furthermore, the present invention is applicable to a liquid ejecting apparatus for applying various kinds of processing (such as printing, processing, coating, irradiating, reading, and inspecting) to various kinds of medium (e.g., a sheet) by using a head capable of ejecting liquid. Examples of the medium (including a print medium) include various mediums such as paper, plastic, a film, fabric, metal, and a flexible board, to which liquid such as ink is applied, whatever the material may be.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2014-093758, filed Apr. 30, 2014, and No. 2015-034180, filed Feb. 24, 2015, which are hereby incorporated by reference wherein in their entirety.

What is claimed is:

1. A liquid supplying apparatus configured to supply liquid to a liquid ejection head capable of ejecting liquid, the liquid supplying apparatus comprising:

a liquid container configured to contain liquid therein;

a filter chamber that is divided into a first filter chamber and a second filter chamber via a filter;

a first supply path configured to allow the first filter chamber and the liquid container to communicate with each other;

a second supply path configured to allow the second filter chamber and the liquid ejection head to communicate with each other;

a bypass path configured to allow the first filter chamber and the liquid container to communicate with each other;

a pump configured to circulate the liquid through the first supply path and the bypass path between the liquid container and the first filter chamber; and a valve capable of regulating the flow of the liquid in the second supply path.

2. The liquid supplying apparatus according to claim 1, wherein the pump is a pressurizing pump configured to press-feed the liquid contained in the liquid container to the first filter chamber through the first supply path.

3. The liquid supplying apparatus according to claim 1, wherein the pump is a suction pump configured to suck the liquid staying in the first filter chamber, and then, feed the liquid into the liquid container through the bypass path.

4. The liquid supplying apparatus according to claim 1, wherein the valve regulates the flow of the liquid in the second supply path in a case where the liquid is circulated between the liquid container and the first filter chamber by the pump.

5. The liquid supplying apparatus according to claim 4, wherein the valve regulates the flow of the liquid in the second supply path by a pressure of the liquid in a case where the liquid is circulated between the liquid container and the first filter chamber.

6. The liquid supplying apparatus according to claim 5, wherein the valve comprises: a first chamber communicating with the second filter chamber via the second supply path; a second chamber communicating with the liquid ejection head via the second supply path; a communication path configured to allow the first chamber and the second chamber to communicate with each other; and a valve body configured to open or close the communication path according to a difference in pressure between the first chamber and the second chamber.

7. The liquid supplying apparatus according to claim 6, wherein the valve further comprises: a flexible member configured to be displaced according to the difference in pressure between the first chamber and the second chamber; a transmitting unit configured to transmit the displacement of the flexible member to the valve body; and an urging member configured to urge the valve body in a direction in which the communication path is closed.

8. A liquid ejecting apparatus comprising:

the liquid supplying apparatus according to claim 1; and a liquid ejection head capable of ejecting liquid to be supplied from the liquid supplying apparatus.

9. An inkjet printing apparatus comprising:

the liquid supplying apparatus according to claim 1, the liquid supplying apparatus supplying ink as liquid;

an inkjet printing head configured to eject the ink to be supplied from the liquid supplying apparatus; and a moving unit configured to relatively move the inkjet printing head and a print medium.

10. A liquid supplying method of supplying liquid contained in a liquid container to a liquid ejection head by using a filter chamber divided into a first filter chamber and a second filter chamber via a filter, the liquid being supplied from the liquid container to the liquid ejection head through the first filter chamber, the filter, and the second filter chamber the liquid supplying method comprising the step of:

regulating the flow of the liquid between the second filter chamber and the liquid ejection head in a case where the liquid is circulated between the liquid container and the first filter chamber.

11. The liquid supplying method according to claim 10, further comprising the step of circulating the liquid between the liquid container and the first filter chamber so as to introduce an air bubble residing in the first filter chamber into the liquid container, thus purging the air bubble.

12. A liquid supplying apparatus configured to supply liquid to a liquid ejection head capable of ejecting liquid, the liquid supplying apparatus comprising:

a liquid container configured to contain liquid therein;

a filter chamber that is divided into a first filter chamber and a second filter chamber via a filter;

a first supply path configured to allow the first filter chamber and the liquid container to communicate with each other;

a second supply path configured to allow the second filter chamber and the liquid ejection head to communicate with each other;

a third supply path configured to allow the first filter chamber and the liquid container to communicate with each other;

a pressurizing pump provided on the first supply path and configured to press-feed the liquid contained in the liquid container to the first filter chamber; and a valve provided on the second supply path, the valve comprising: a first chamber communicating with the second filter chamber via the second supply path; a second chamber communicating with the liquid ejection head via the second supply path; a communication path allowing the first chamber and the second chamber to communicate with each other; and a valve body capable of opening or closing the communication path, the valve body acting in a direction in which the communication path is closed according to an increase in pressure inside of the first chamber.

13. The liquid supplying apparatus according to claim 12, wherein a part of the second chamber of the valve includes a flexible film.

14. The liquid supplying apparatus according to claim 12, wherein a resilient member is provided inside of the first chamber of the valve.

15. The liquid supplying apparatus according to claim 14, wherein the resilient member is urged in a direction in which the communication path is closed.

* * * * *